US008375764B2

(12) United States Patent
Huang

(10) Patent No.: US 8,375,764 B2
(45) Date of Patent: Feb. 19, 2013

(54) PIPE BENDER

(76) Inventor: Chang Yang Huang, Taichung (TW)

( * ) Notice: Subject to any disclaimer, the term of this patent is extended or adjusted under 35 U.S.C. 154(b) by 85 days.

(21) Appl. No.: 13/103,096

(22) Filed: May 8, 2011

(65) Prior Publication Data

US 2012/0085141 A1 Apr. 12, 2012

(30) Foreign Application Priority Data

Oct. 7, 2010 (TW) ..... 99219344 U

(51) Int. Cl.
*B21D 7/06* (2006.01)
*B21D 9/08* (2006.01)

(52) U.S. Cl. ..... 72/389.8; 72/389.1; 72/389.2; 72/390.5; 72/409.18; 72/442; 72/477; 72/482.93; 140/147

(58) Field of Classification Search ..... 72/389.1, 72/389.2, 389.3, 390.2, 390.5, 409.18, 442, 72/477, 482, 389.8, 482.93; 140/147
See application file for complete search history.

(56) References Cited

U.S. PATENT DOCUMENTS

| | | | | | |
|---|---|---|---|---|---|
| 1,824,219 | A * | 9/1931 | Loveless | 72/409.01 |
| 3,747,648 | A * | 7/1973 | Bauer | 140/147 |
| 3,822,578 | A * | 7/1974 | Le Breton | 72/390.2 |
| 4,077,249 | A * | 3/1978 | Schmitter | 72/390.2 |
| 4,488,425 | A * | 12/1984 | Meikle | 72/389.2 |
| 5,105,646 | A * | 4/1992 | Koskinen | 72/390.2 |
| 6,931,908 | B1 * | 8/2005 | Mitson | 72/390.2 |

* cited by examiner

*Primary Examiner* — David B Jones

(57) ABSTRACT

A pipe bender includes first and second handles pivotably secured together wherein the second handle includes first and second rotatable pipe receiving grooves at both ends of a forward U; a support member threadedly fastened between a forward bifurcation of the first handle, the support member comprising a spring depressible detent on the bottom, and a plurality of markings on the top; and a slide member comprising a plurality of parallel arcuate pipe receiving channels of different arcuate perimeters on a lower surface, a central U-shaped trough on the top for receiving a lower portion of the support member, retaining holes on the bottom of the U-shaped trough, each retaining hole being aligned with one pipe receiving channel and one retaining hole adapted to lockingly receive the detent for positioning. The slide member is slidably retained by the support member.

2 Claims, 9 Drawing Sheets

PIPE BENDER

BACKGROUND OF THE INVENTION

1. Field of the Invention

The invention relates to pipe benders and more particularly to a hand-held pipe bender with improved characteristics including capable of cutting one of four pipes of different sizes.

2. Description of Related Art

Because stock conduit typically is provided in linear portions, it often must be bent into various shapes to suit these purposes. However, when bending the conduit, it is important to avoid collapsing, crimping or deforming the conduit sidewalls to preserve the lumen within. This is necessary to prevent forming obstructions in the conduit and to avoid creating breaks or sharp angles in the conduit's interior surfaces.

Construction workers frequently find it necessary to use many different sizes of conduit in any given construction project. In some instances, small conduit may be needed to carry relatively few wires through a narrow or tightly restricted area. In another application, however, an electrician may find that he needs to use a large diameter section of conduit to accommodate a large number of wires. In recognition of this need, commercial manufacturers provide electrical conduit in several standard sizes having various diameters and sidewall thicknesses. It is desirable that a pipe bender be versatile to accommodate the requirements of each type of conduit.

Pipe benders having multiple pipe receiving channels for cutting pipes of different sizes have been described in many patents and non-patent literatures. Notwithstanding the prior art, the invention is neither taught nor rendered obvious thereby.

SUMMARY OF THE INVENTION

It is therefore one object of the invention to provide a pipe bender comprising a first handle comprising a first yoke arm and a parallel second yoke arm; a second handle pivotably secured to the first handle and comprising a U-shaped member under the first and second yoke arms, the second handle including a first roller at one end, the first roller having a first pipe receiving groove, and a second roller at the other end, the second roller having a second pipe receiving groove; a support member having a longitudinal section of inverted T, the support member being threadedly fastened between the first yoke arm and the second yoke arm, the support member comprising a spring depressible detent on the bottom, and a plurality of markings on the top; and a slide member comprising a plurality of parallel arcuate pipe receiving channels of different arcuate perimeters on a lower surface, a lengthwise U-shaped trough on a central portion of a top surface, the U-shaped trough being adapted to receive a lower portion of the support member, a plurality of retaining holes on the bottom of the U-shaped trough, each retaining hole being aligned with one of the pipe receiving channels and one of the retaining holes being adapted to lockingly receive an end of the spring depressible detent for positioning; wherein the slide member is frictionally retained by the support member by threadedly fastening the slide member and the support member together so that the slide member is adapted to slide relative to the support member for aligning one of the pipe receiving channels with both the first and second pipe receiving grooves.

The above and other objects, features and advantages of the invention will become apparent from the following detailed description taken with the accompanying drawings.

DETAILED DESCRIPTION OF THE INVENTION

Figure 1:
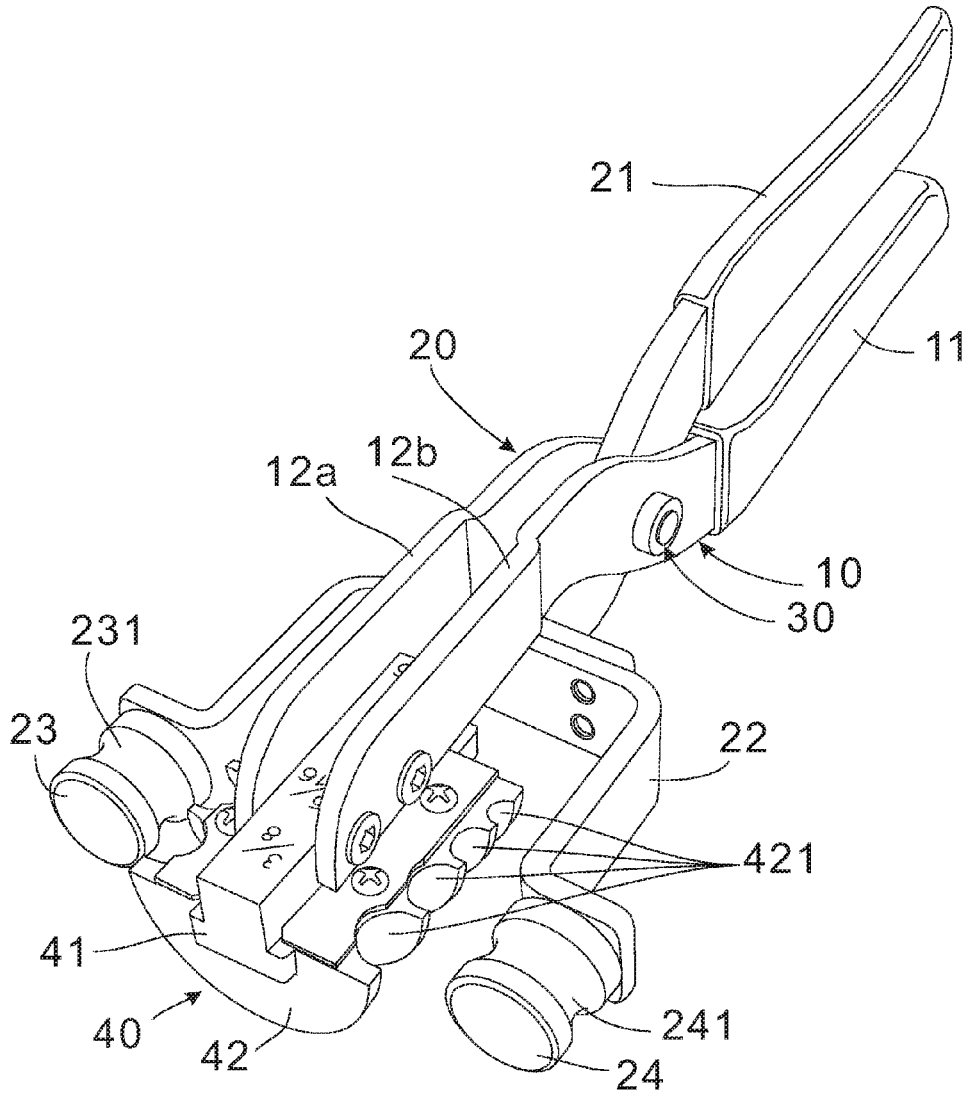
FIG. 1 is a perspective view of a pipe bender according to a first preferred embodiment of the invention.
Figure 2:
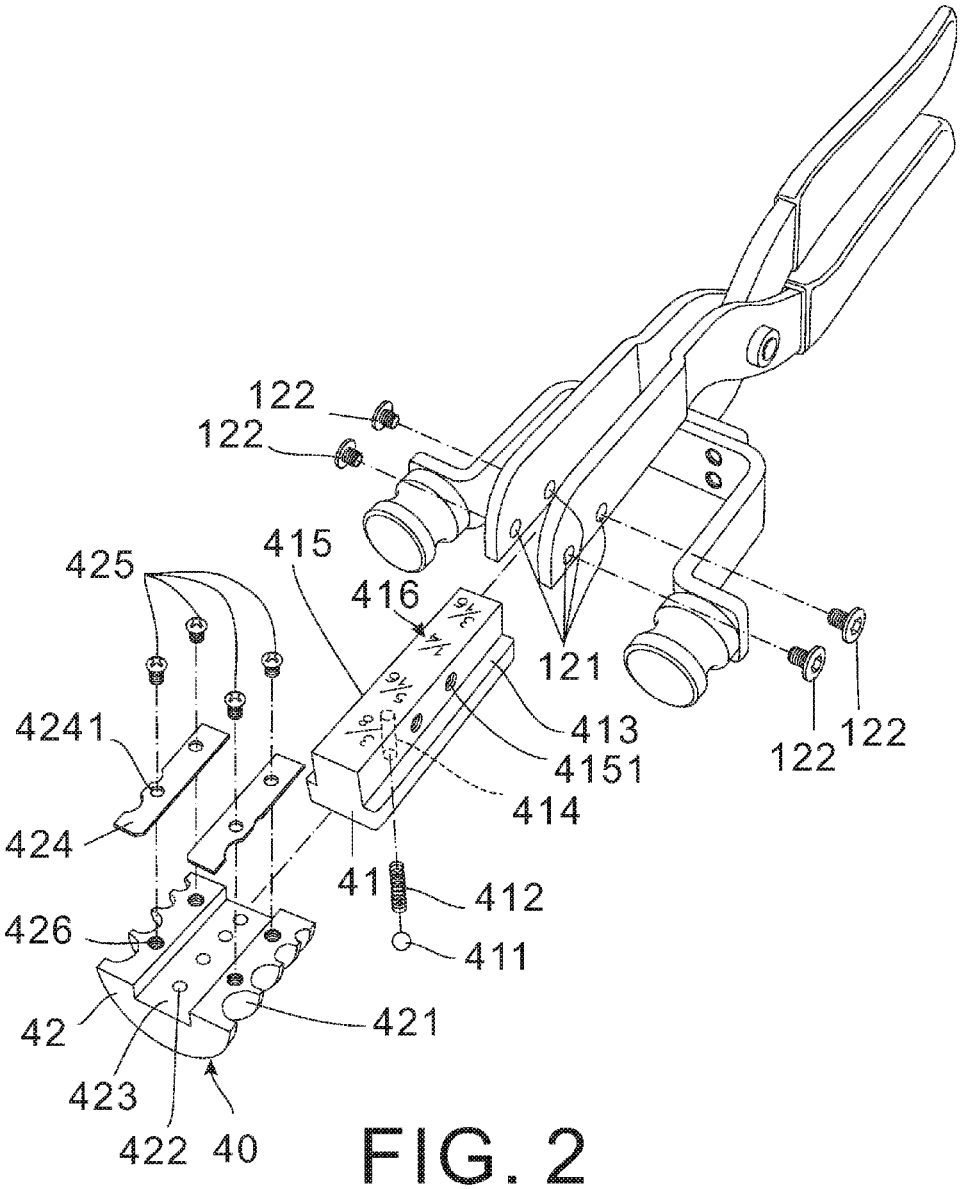
FIG. 2 is an exploded view of FIG. 1.
Figure 3:
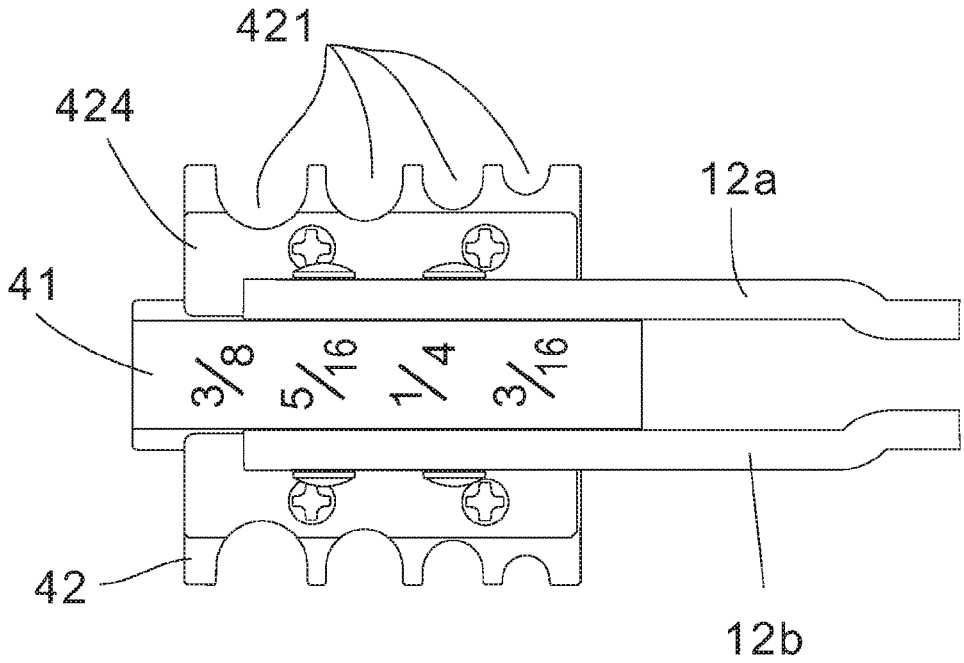
FIG. 3 is a top view of the yoke arms, the slide member, and the support member of FIG. 1.
Figure 4:
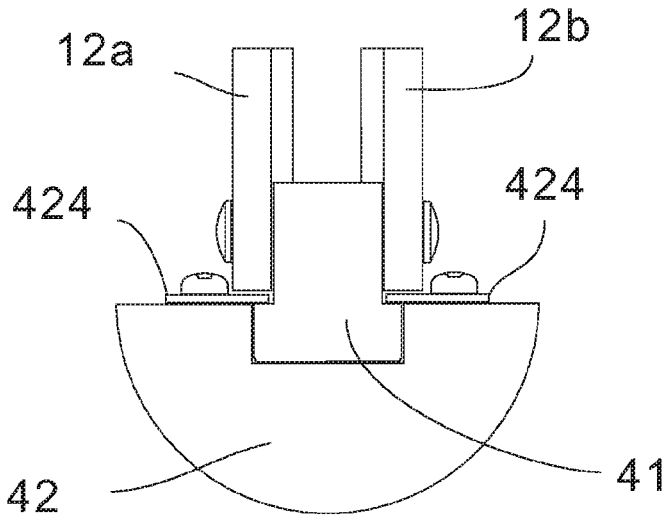
FIG. 4 is a front end view of FIG. 3.
Figure 5:
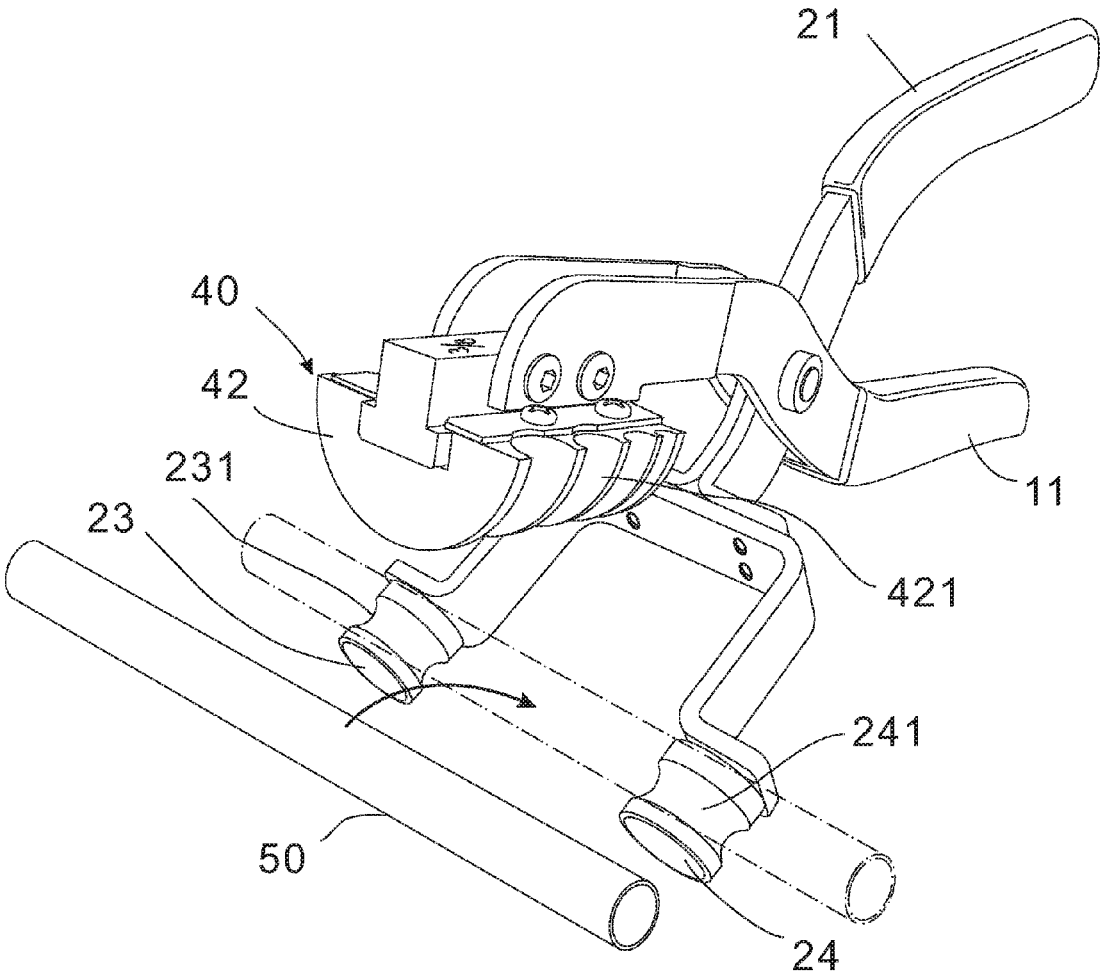
FIGS. 5 and 6 are perspective view showing a pipe bending operation of the pipe bender according to a first preferred embodiment of the invention.
Figure 6:
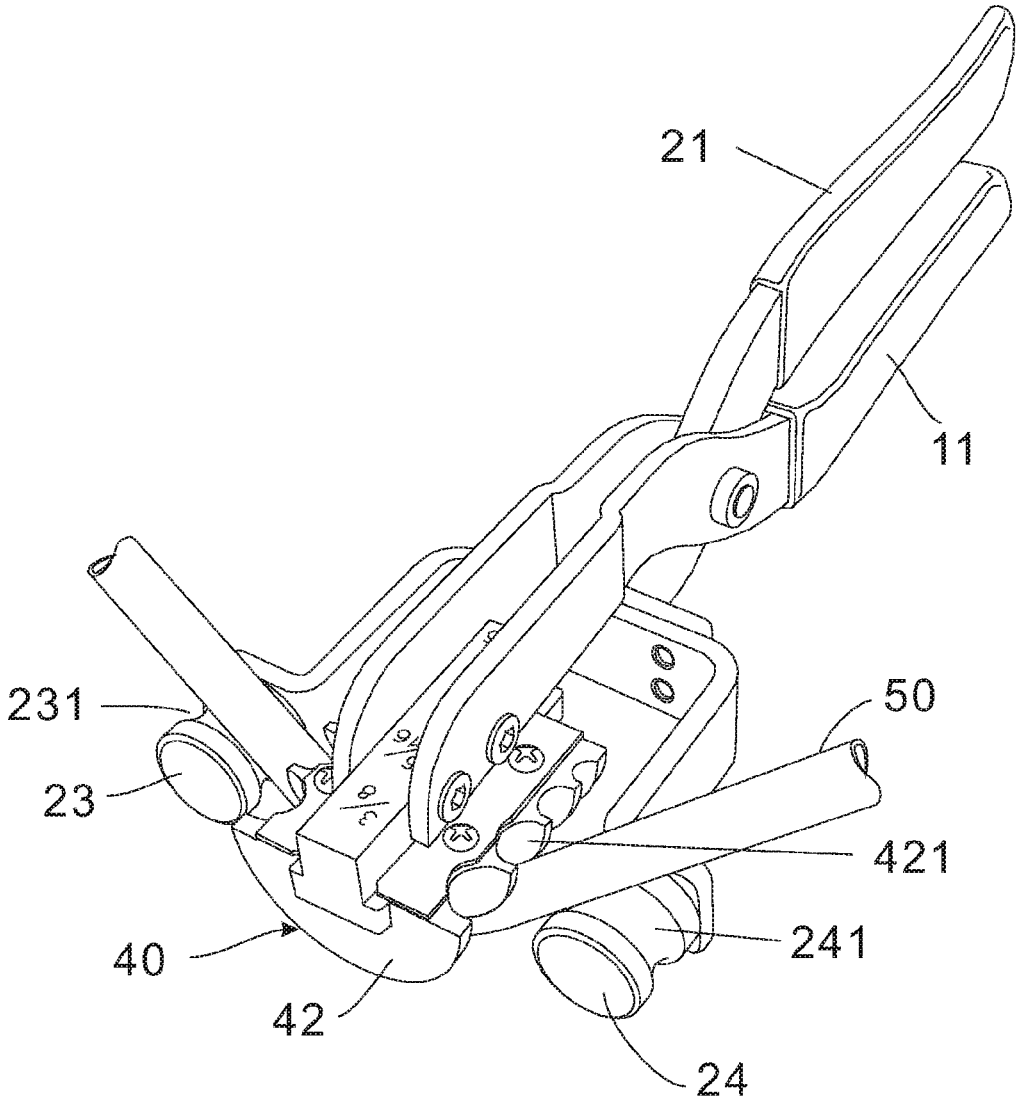

Referring to FIGS. 1 to 6, a pipe bender in accordance with a first preferred embodiment of the invention comprises the following components as discussed in detail below.

A bent first lever 10 and a bent second lever 20 are provided. The second lever 20 comprises a rear second handle 21 and the first lever 10 comprises a rear first handle 11. The first lever 10 further comprises a first yoke arm 12*a* and a parallel second yoke arm 12*b* both extending forward from the first handle 11. A forward portion of the second lever 20 extending from the second handle 21 passes an elongated gap between the first and second yoke arms 12*a* and 12*b*. A pivot joint 30 is driven through the first yoke arm 12*a*, the elongated gap between the first and second yoke arms 12*a* and 12*b*, and the second yoke arm 12*b* to pivotably join the first and second levers 10, 20 together. Two spaced through holes 121 are formed adjacent to a lower straight edge of each of the first and second yoke arm 12*a* and 12*b* respectively. The forward portion of the second lever 20 is formed as a U-shaped member 22 having a first roller 23 and a second roller 24 rotatably attached to both ends respectively. The first roller 23 has a concave, circumferential surface on an intermediate portion served as a first pipe receiving groove 231 and the second roller 24 has a concave, circumferential surface on an intermediate portion served as a second pipe receiving groove 241.

A sliding mechanism 40 comprises a support member 41 and a slide member 42. The support member 41 has a longitudinal section of inverted T and comprises a cylindrical hole 414 open to the flat bottom surface, a torsion spring 412 disposed in the hole 414, a steel ball 411 engaged with one end of the spring 412 proximate to the mouth of the hole 414, a vertical part 415 having a rectangular longitudinal section, two L-shaped shoulders 413 between a lower horizontal portion of the support member 41 and the vertical part 415, two spaced threaded holes 4151 on each side of the vertical part 415, and a plurality of markings 16 indicating pipe sizes 3/16, 1/4, 5/16, and 3/8 respectively. A plurality of threaded fasteners (e.g., screws) 122 can be driven through the through holes 121 into the threaded holes 4151 to fasten the support member 41 in the gap between the first and second yoke arms 12*a* and 12*b*.

The slide member 42 has a longitudinal section of about half disc. The slide member 42 comprises a plurality of (four are shown) parallel arcuate pipe receiving channels 421 of different arcuate perimeters formed on a lower surface, a lengthwise U-shaped trough 423 on a central portion of a top surface, a plurality of (four are shown) retaining holes 422 on the bottom of the trough 423, each retaining hole 422 being aligned with the corresponding pipe receiving channel 421, two sets of two threaded holes 426 on the top surface, each set of the two threaded holes 426 being between the trough 423 and either end of the pipe receiving channel 421, two elongated mounting plates 424 each having two spaced through holes 4241, and four threaded fasteners 425. The trough 423 is complimentarily engaged with the lower horizontal portion of the support member 41 with the portion of the flat top surface of the slide member 42 other than the trough 423 being flush with the bottom of the L-shaped shoulders 413. Each mounting plate 424 is placed on the joining portion of the flat top surface of the slide member 42 and the bottom of the L-shaped shoulders 413. The threaded fasteners 425 are driven through the through holes 4241 into the threaded holes 426 to frictionally retain the slide member 42 with the steel ball 411 being pushed by the spring 412 to lockingly engage with one of the retaining holes 422. Outer edge of the mounting plate 424 has two adjacent arcuate indents (not numbered) each corresponding to and longitudinally aligned with a portion of either arcuate end of the pipe receiving channel 421.

The markings 16 indicating 3/16, 1/4, 5/16, and 3/8 represent sizes (i.e., outer diameter) of four different pipes respectively. That is, the sizes of the pipe receiving channels 421 increase from forward to rearward. Prior to a bending operation, an operator may pull the slide member 42 forward to remove it from the support member 41. Alternatively, the operator may push the positioned slide member 42 toward the transverse part of the U-shaped member 22. And in turn, the steel ball 411 clears the retaining hole 422. The operator can stop the pushing if a desired pipe receiving channel 421 is transversely aligned with both the first pipe receiving groove 231 and the second pipe receiving groove 241. The steel ball 411 thus lockingly engages with another retaining hole 422. Preferably, the pushing will be stopped by the transverse part of the U-shaped member 22 for preventing the slide member 42 from disengaging from the support member 41. Also, the steel ball 411 automatically lockingly engages with the rear retaining hole 422 when the pushing is stopped by the transverse part of the U-shaped member 22.

The operator may pivot the handles 11, 21 away from each other to open the mouth of the pipe bender (i.e., pivot the slide member 42 away from the U-shaped member 22). Next, place a straight pipe 50 across the first pipe receiving groove 231 and the second pipe receiving groove 241. It is noted that the size (i.e., circular perimeter) of the pipe 50 corresponds to the desired pipe receiving channel 421 and the pipe 50 is in alignment therewith. Next, pivot the handle 11, 21 toward each other to decrease the mouth of the pipe bender in order to force the pipe 50 to bend around an arc from the first pipe receiving groove 231, the desired pipe receiving channel 421, and the second pipe receiving groove 241. The operator may stop the bending if a desired curved shape of the pipe 50 has been obtained. An operation of pivoting the handles 11, 21 away from each other can open the mouth again so as to remove the bent pipe 50. It is envisaged that four pipes 50 having outer diameters of 3/16 inch, 1/4 inch, 5/16 inch, and 3/8 inch can be bent respectively by the invention.

Figure 7:
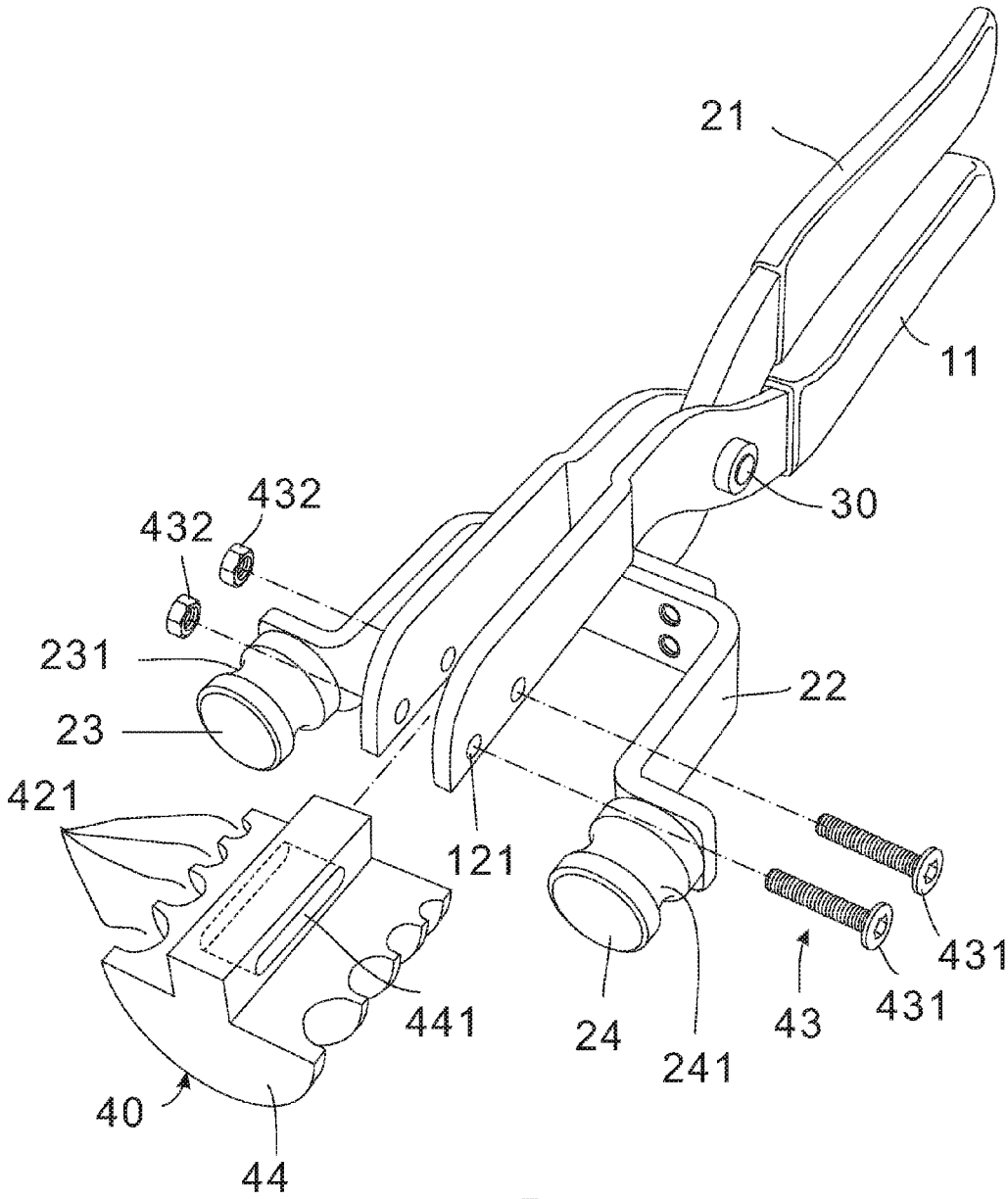
FIG. 7 is an exploded view of a pipe bender according to a second preferred embodiment of the invention.
Figure 8:
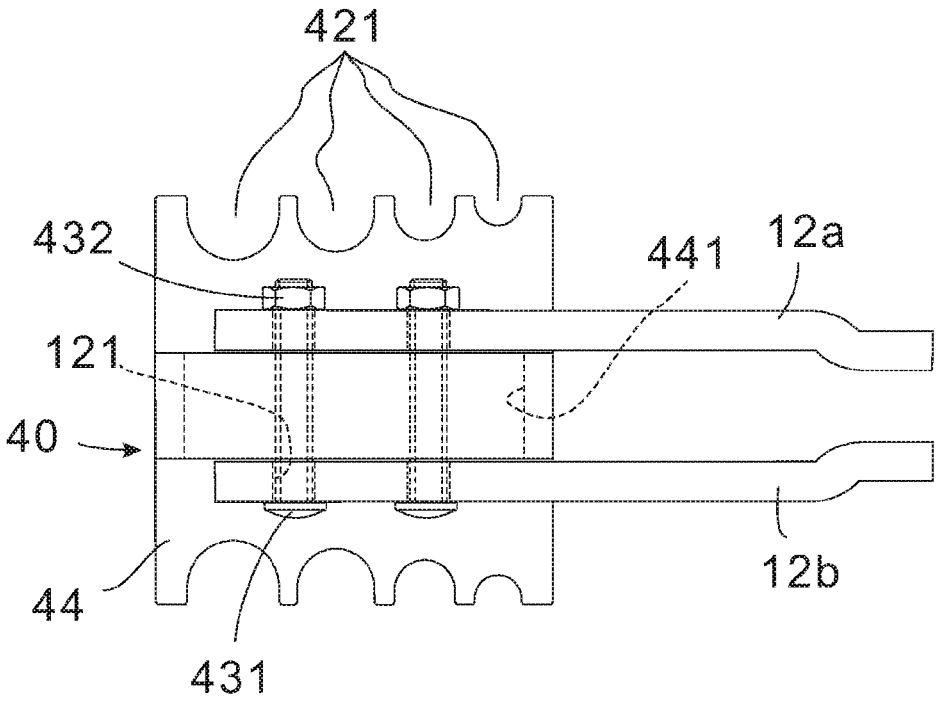
FIG. 8 is a top view of the yoke arms and the sliding mechanism of FIG. 7.
Figure 9:
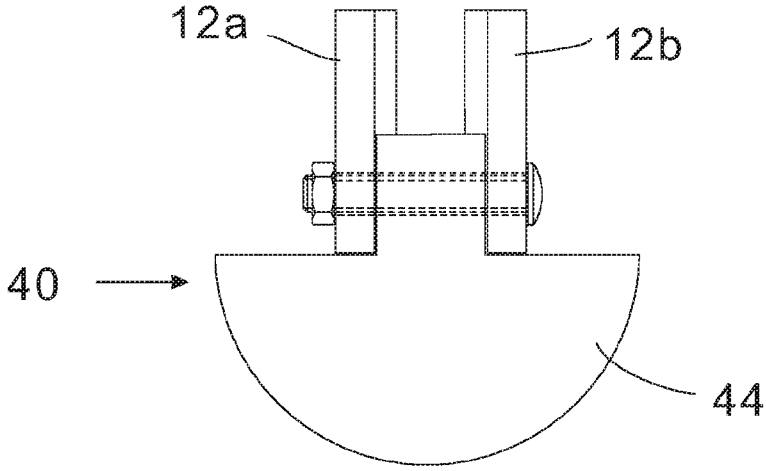
FIG. 9 is a front end view of FIG. 8.

Referring to FIGS. 7, 8 and 9, a pipe bender in accordance with a second preferred embodiment of the invention is shown. The characteristics of the second preferred embodiment are substantially the same as that of the first preferred embodiment except the following: The sliding mechanism 40 comprises a slide member 44 which is an integral member. That is, the support member and the slide member of the first preferred embodiment are formed integrally. The slide member 44 does not have scale markings. An elongated slot 441 having both sides open is formed on a vertical part of the slide member 44. Each threaded fastener 43 is implemented as a bolt 431 and a nut 432 combination. An operator may push or pull the slide member 44 so as to align a desired pipe receiving channel 421 with both the first pipe receiving groove 231 and the second pipe receiving groove 241. Next, the operator may drive the bolts 431 through the through holes 121 of the second yoke arm 12*b*, the slot 441, the through holes 121 of the first yoke arm 12*a*, and the nuts 432 to retain the slide member 44 which is allowed to frictionally move a distance no more than a maximum distance from either end of the slot 441 to the adjacent through holes 121 relative to the first handle 11 for aligning a desired pipe receiving channel 421 with both the first pipe receiving groove 231 and the second pipe receiving groove 241 prior to pipe bending operation.

Figure 10:
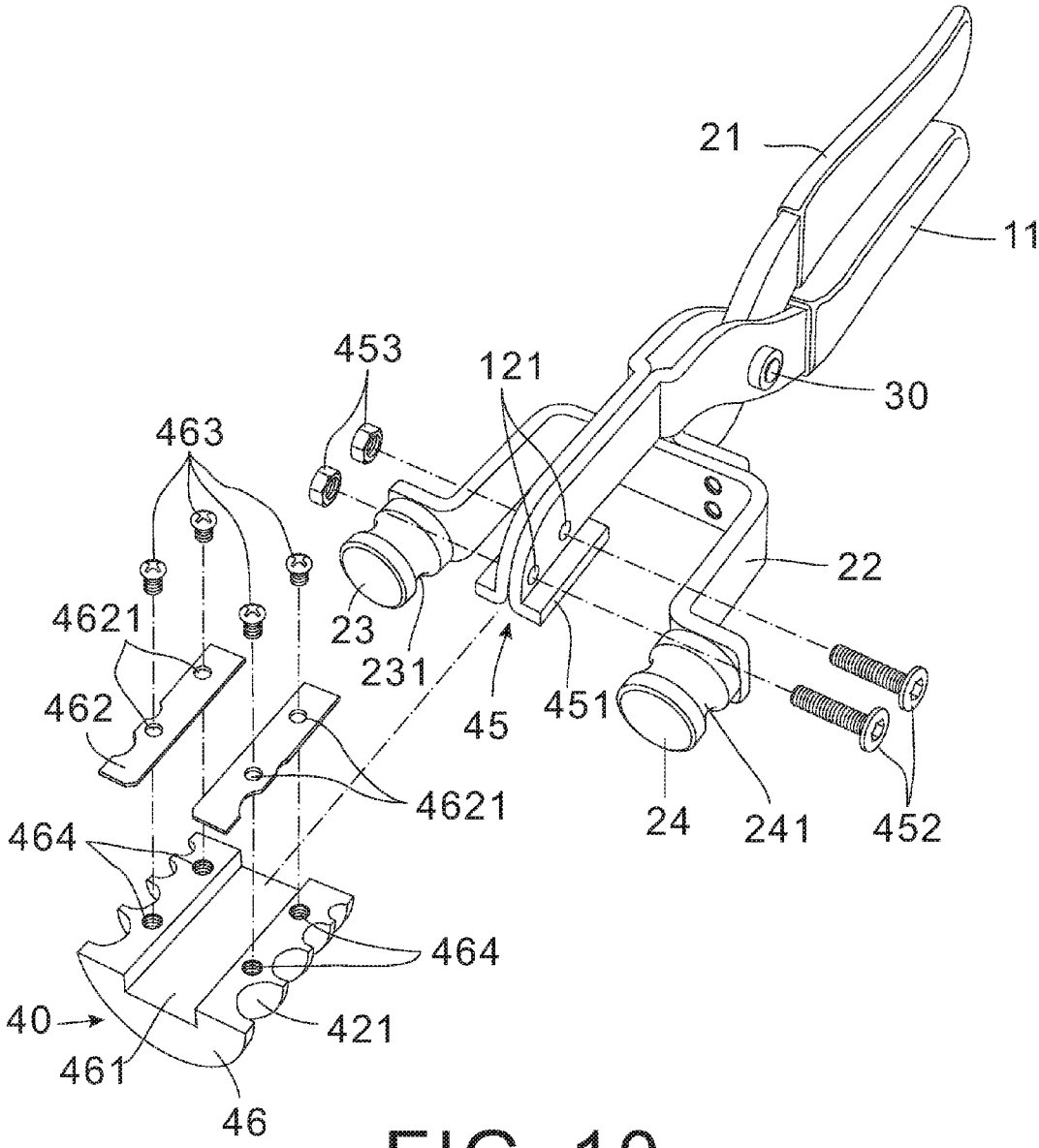
FIG. 10 is an exploded view of a pipe bender according to a third preferred embodiment of the invention.
Figure 11:
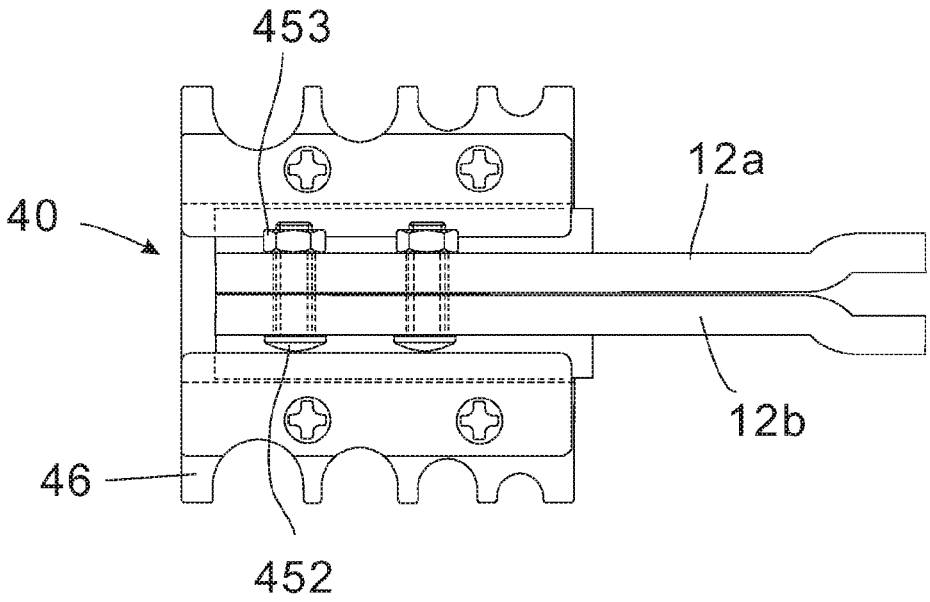
FIG. 11 is a top view of the yoke arms and the sliding mechanism of FIG. 10.
Figure 12:
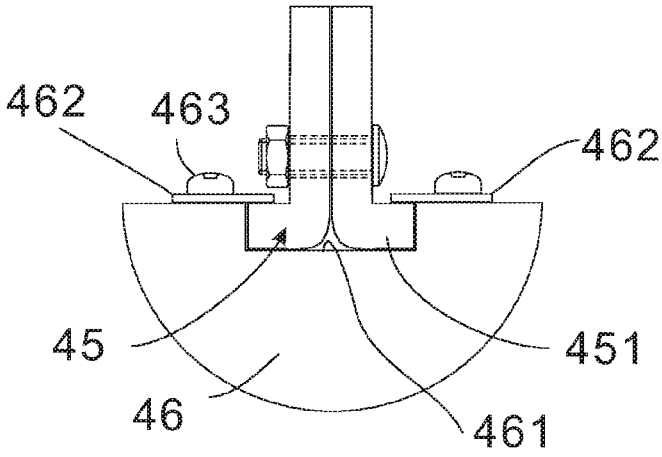
FIG. 12 is a front end view of FIG. 11.

Referring to FIGS. 10, 11, and 12, a pipe bender in accordance with a third preferred embodiment of the invention is shown. The characteristics of the third preferred embodiment are substantially the same as that of the first preferred embodiment except the following: The first yoke arm 12*a* and the second yoke arm 12*b* are engaged. A front bottom edge of each of the first yoke arm 12*a* and the second yoke arm 12*b* extends outward to form a rectangular extension 451. The two extensions 451 are served as a rail 45. Two bolts 452 each can be driven through the through hole 121 into a nut 453 so as to fasten the first and second yoke arms 12*a*, 12*b* together. The sliding mechanism 40 comprises a slide member 46 with no scale markings. The slide member 46 has a longitudinal section of about half disc. The slide member 46 comprises a plurality of (four are shown) parallel arcuate pipe receiving channels 421 of different arcuate perimeters formed on a lower surface, a lengthwise U-shaped trough 461 on a central portion of a top surface, two sets of two threaded holes 464 on the top surface, each set of the two threaded holes 464 being between the trough 461 and either end of the pipe receiving channel 421, two elongated mounting plates 462 each having two spaced through holes 4621, and four threaded fasteners 463. The trough 461 is complimentarily engaged with the rail 45 with the portion of the flat top surface of the slide member 46 other than the trough 461 being flush with the top of either extension 451. Each mounting plate 462 is placed on the joining portion of the flat top surface of the slide member 46 and the top of the extension 451. The threaded fasteners 463 are driven through the through holes 4621 into the threaded holes 464 to frictionally retain the slide member 46 which is allowed to frictionally move relative to the rail 45 for aligning a desired pipe receiving channel 421 with both the first pipe receiving groove 231 and the second pipe receiving groove 241 prior to pipe bending operation.

While the invention has been described in terms of preferred embodiments, those skilled in the art will recognize that the invention can be practiced with modifications within the spirit and scope of the appended claims.

What is claimed is:

1. A pipe bender comprising:

a first handle comprising a first yoke arm and a parallel second yoke arm;

a second handle pivotably secured to the first handle and comprising a U-shaped member under the first and second yoke arms, the U-shaped member including a first roller at a first end, the first roller having a first pipe receiving groove, and a second roller at a second end opposite to the first end thereof, the second roller having a second pipe receiving groove;

a support member having a longitudinal section of an inverted T, the support member being threadedly fastened between the first yoke arm and the second yoke arm, the support member comprising a spring depressible detent on a bottom, and a plurality of markings on a top; and a slide member comprising a plurality of parallel arcuate pipe receiving channels of different arcuate perimeters on a lower surface, a lengthwise U-shaped trough on a central portion of a top surface, the U-shaped trough being adapted to receive a lower portion of the support member, a plurality of retaining holes on a bottom of the U-shaped trough, each retaining hole being aligned with one of the pipe receiving channels and one of the retaining holes being adapted to lockingly receive an end of the spring depressible detent for positioning;

wherein the slide member is frictionally retained by the support member by moveably securing it to the support member so that the slide member is adapted to slide relative to the support member for aligning one of the pipe receiving channels with both the first and second pipe receiving grooves.

2. A pipe bender comprising:

a first handle comprising a first yoke arm, a second yoke arm pivotably secured to the first yoke arm, and a rail having a first half portion being unitary with the first yoke arm and a second half portion being unitary with the second yoke arm;

a second handle pivotably secured to the first handle and comprising a U-shaped member under the first and second yoke arms, the U-shaped member including a first roller at a first end, the first roller having a first pipe receiving groove, and a second roller at a second end opposite to the first end thereof, the second roller having a second pipe receiving groove; and a slide member comprising a plurality of parallel arcuate pipe receiving channels of different arcuate perimeters on a lower surface, and a lengthwise U-shaped trough on a central portion of a top surface, the U-shaped trough being adapted to receive the rail;

wherein the slide member is frictionally retained by the rail by moveably securing it to the rail so that the slide member is adapted to slide relative to the rail for aligning one of the pipe receiving channels with both the first and second pipe receiving grooves.

* * * * *